United States Patent [19]

Claudet et al.

[11] 3,992,893

[45] Nov. 23, 1976

[54] METHOD FOR THE PRODUCTION OF SUPERFLUID HELIUM UNDER PRESSURE AT VERY LOW TEMPERATURE AND AN APPARATUS FOR CARRYING OUT SAID METHOD

[75] Inventors: Gérard Claudet, Grenoble; Pierre Roubeau, Palaiseau; Jacques Verdier, Meylan, all of France

[73] Assignee: Commissariat a l'Energie Atomique, Paris, France

[22] Filed: Feb. 11, 1975

[21] Appl. No.: 549,079

[30] Foreign Application Priority Data

Feb. 22, 1974 France ..... 74.06206

[52] U.S. Cl. ..... 62/113; 62/467 R; 62/502

[51] Int. Cl.[2] ..... F25B 41/00

[58] Field of Search ..... 62/113, 502, 514, 45, 62/55, 467

[56] References Cited

UNITED STATES PATENTS

| | | | |
|---|---|---|---|
| 3,195,322 | 7/1965 | London | 62/502 X |
| 3,581,512 | 6/1971 | Staas et al. | 62/514 R |
| 3,589,138 | 6/1971 | Severijns et al. | 62/514 R |

*Primary Examiner*—Kenneth W. Sprague
*Assistant Examiner*—Ronald C. Capossela
*Attorney, Agent, or Firm*—Lane, Aitken, Dunner & Ziems

[57] ABSTRACT

A bath of helium-4 is cooled to a temperature below the λ point so as to convert the lower portion of the bath to a superfluid-helium zone. A narrow stream between a top and a bottom portion of the zone is subjected to a critical heat flux corresponding to a temperature gradient by cooling the bath in the bottom portion of the superfluid-helium zone, the temperatures thus attainable being considerably lower than the λ transition point.

13 Claims, 9 Drawing Figures

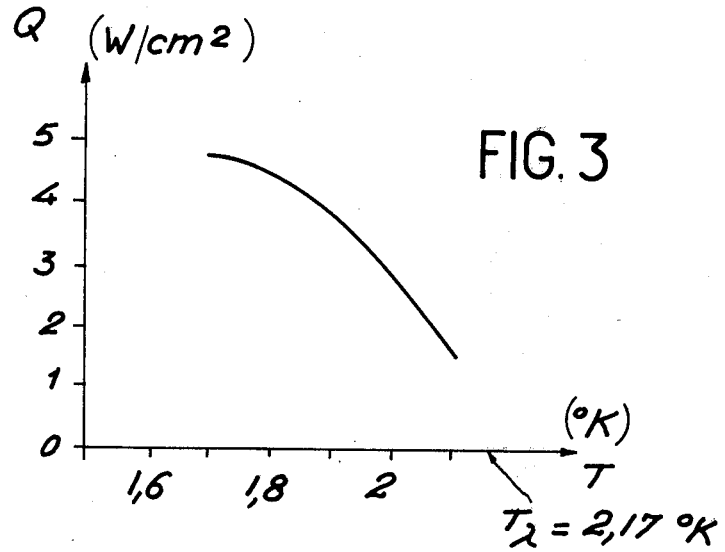
FIG. 3
FIG. 4
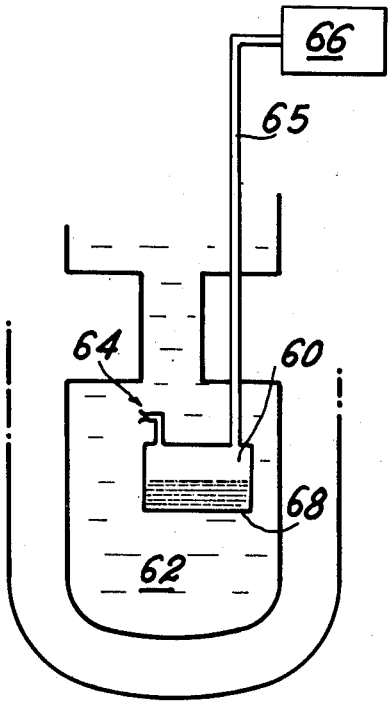
FIG. 5
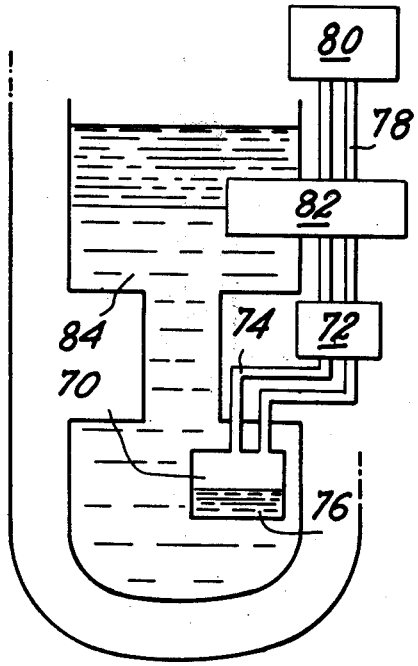

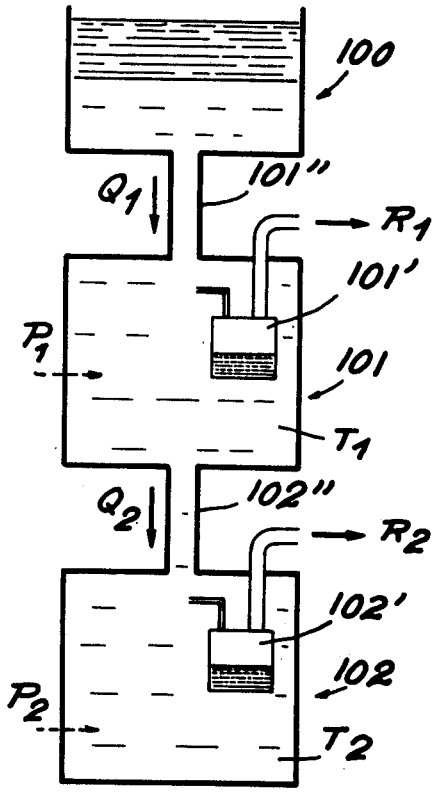
FIG. 8
FIG. 9
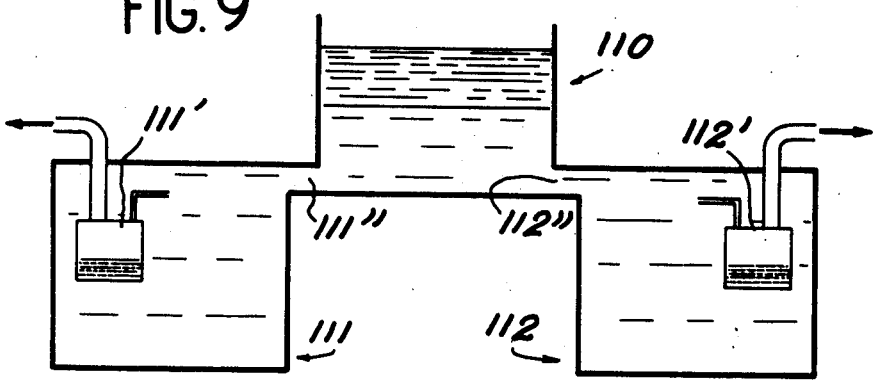

METHOD FOR THE PRODUCTION OF SUPERFLUID HELIUM UNDER PRESSURE AT VERY LOW TEMPERATURE AND AN APPARATUS FOR CARRYING OUT SAID METHOD

This invention relates to a method for the production of superfluid helium under pressure at very low temperature and to an apparatus for carrying out said method.

The invention finds an application in the cooling of superconducting coils for generating strong magnetic fields and more generally in the production of very low temperatures for a number of different applications in physics.

It is known that, below the temperature of the λ point (2.17° K) and under certain conditions of pressure, helium-4 exists in a newly found state known as helium II or superfluid helium. At the λ point, there are observed discontinuous changes in the specific heat, the specific volume, the heat of vaporization and above all in viscosity and thermal conductivity. As a consequence, superfluid helium exhibits very advantageous properties in cryogenics both in regard to the range of temperatures attainable and in regard to the quality of heat transfer which it is capable of producing. However, superfluid helium is in fairly limited use by reason of the difficulties attached to the practical application of the conventional method of production which is based on a reduction of the vapor pressure to less than 38 torr.

These difficulties essentially arise from operation at low pressure and primarily involve the following points: the potential danger of air admission, the need to employ enclosures having high mechanical strength, low dielectric strength of the gas, disturbance at the time of injections of helium, increased losses caused by the appearance of a superfluid film, considerable pumping means, the size of which is a function of the introductions of heat in the helium bath and so forth.

One solution to these problems has been proposed by Pierre Roubeau in an article entitled "Cryogenic bath of liquid helium-4 having a temperature gradient with coexistence of superfluid and normal phases," published in "Comptes-rendus a l'Academie des Sciences," Paris, Oct. 4th, 1971, volume 273, series B-38, page 581. In accordance with the method described in this article, a small cold-producing source is immersed in a bath of normal helium under atmospheric pressure so as to impose a downward thermal flux from the surface of the bath to the cold source. Said flux can pass through the normal helium (which has low thermal conductivity) only if there appears a temperature gradient such that the bottom of the bath cools to a temperature of 2.17° K at which the helium undergoes a transition to the superfluid state. From that point, the temperature no longer falls and the superfluid zone develops. It finally reaches a level of equilibrium when the heat removed by the cold source is exactly counterbalanced by the heat supplied to the superfluid zone by external addition (through the neck of the cryostat or through the lateral walls), by internal dissipation and by conduction of the normal-helium layer.

Although this method does offer a solution to the problems raised by the methods based on a reduction of vapor pressure to less than 38 torr, there is nevertheless an attendant disadvantage in that it results in the production of superfluid helium whose temperature remains in the immediate vicinity of the temperature of the λ point. The method according to the invention and the device for the application of the method have the precise object of displacing this limit towards much lower temperatures.

The essential feature of the invention consists in producing at the upper portion of the superfluid zone a temperature gradient which is added to the temperature gradient created within the normal-helium layer. In order to obtain this temperature gradient in the superfluid zone, a downward heat flux between the upper and lower portions of the superfluid zone is imposed so that the temperature of the lower zone is reduced by a value which is a function of the imposed thermal flux.

In more exact terms, the present invention is directed to a method for the production of superfluid helium under pressure at a very low temperature, of the type in which a bath of helium-4 is cooled locally in order to cause its temperature to fall below the λ point, the lower portion of said bath being then converted into a superfluid-helium zone. The method consists in connecting the upper portion of the superfluid zone to the lower portion of said zone by means of a narrow stream of superfluid hhelium and in imposing within said stream a critical heat flux corresponding to the establishment of a temperature gradient by carrying out said cooling within said lower portion.

The temperature differnce between said lower and upper portions of the superfluid zone (therefore the temperature of the superfluid helium of the lower portion) can be adjusted by modifying the value of said critical heat flux. To this end, it is possible to modify either the power of the cold source or the dimensions of the superfluid stream in which the temperature gradient is observed.

The present invention is also directed to an apparatus for the production of superfluid helium under pressure at very low temperature and for carrying out the method hereinabove defined, said apparatus being of the type comprising a cryostat containing a liquid-helium bath, means for maintaining the helium pressure at the desired value, local cooling means immersed in said helium bath for causing the temperature of said bath to fall below the λ point, characterized in that said cryostat comprises:

an upper chamber in which superfluid helium collects at the lower portion of said chamber whilst normal helium remains in the upper portion of said chamber, and at least one lower superfluid-helium chamber which is placed beneath said upper chamber and communicates therewith through at least one passageway having suitable dimensions for permitting the conduction of a critical heat flux having a thermal gradient, said cooling means being placed in at least one of said lower chambers containing the superfluid helium.

The cooling means can be constituted by any known installation for removing heat at a temperature level below 2.17° K. The following can be mentioned by way of non-limitative examples:

installations for evaporation of helium-4 within an ancillary circuit which makes it possible to attain temperatures of 1.1° K;

autonomous helium-3 refrigerators which can utilize the main bath for precooling if necessary and make it possible to attain temperatures of the order of 0.7° K;

$He^3/He^4$ dilution refrigerators which are either independent or employ the main bath for precooling and make it possible to attain temperatures of the order of 0.1° K.

The characteristic features and advantages of the invention will in any case become more readily apparent from the following description of practical examples which are given by way of explanation without any limitation being implied, reference being made to the accompanying drawings, wherein:

FIG. 3 represents a curve of variation of the critical heat flux density in superfluid helium under pressure as a function of the temperature in the particular case of a passageway having a diameter of 1.3 mm and a length of 100 mm;

FIG. 4 illustrates a first example of cooling means which can be employed in the apparatus according to the invention;

FIG. 5 illustrates a second example of cooling means which can be employed in the apparatus according to the invention;

FIG. 8 illustrates an alternative form of construction of the apparatus according to the invention in which two superfluid-helium chambers are placed in series;

FIG. 9 shows another alternative form of construction of the apparatus according to the invention in which two superfluid-helium chambers are placed in parallel.

In order to gain a clearer understanding of the original character and properties of the invention, the principle of the method adopted in the prior art for obtaining superfluid helium in the vicinity of the λ point will now be briefly recalled. In order to obtain more specific details on this technique, useful reference can be made to the publicatioan mentioned in the foregoing.

Figure 1:
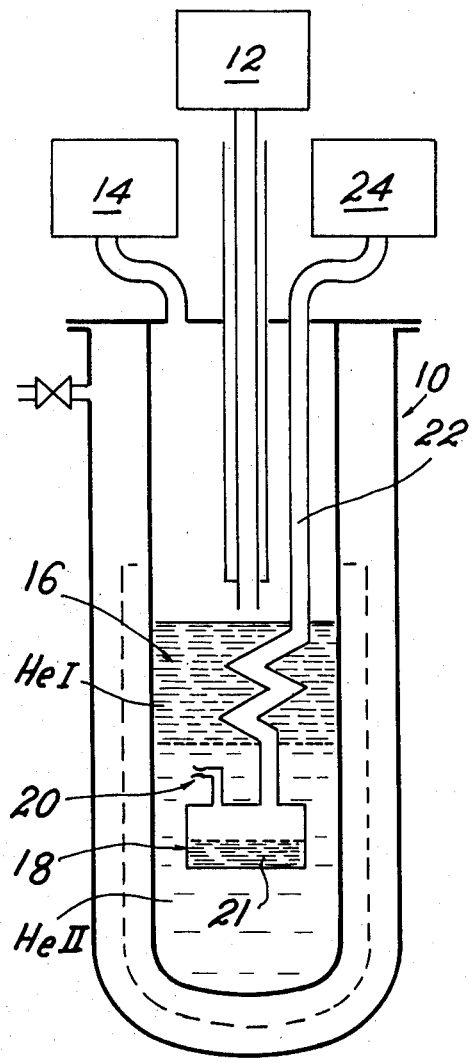
FIG. 1 illustrates an apparatus of the prior art for obtaining superfluid helium under pressure at a temperature which is slightly below that of the λ point.

There is shown in FIG. 1 an apparatus which operates in accordance with this method and comprises a cryostat 10, a source 12 of liquid helium, means 14 for pumping the evaporated helium derived from the helium bath 16. A cooling chamber 18 placed within the cryostat is immersed in the region to be cooled and supplied with liquid helium taken from the surrounding bath through a valve 20 or a calibrated leak. Pumping means 24 and a pipe 22 make it possible to pump the vapors of the liquid 21 which is introduced in the chamber 18 and evaporates while extracting the necessary heat from the main bath 16.

The region surrounding the chamber 18 undergoes progressive cooling which propagates by convection to the entire portion of the bath which is located beneath the chamber 18. Convection is facilitated by the low viscosity of helium and by the appreciable difference between the density at 4.2° K ($d = 0.125$) and the density at 2° K ($d = 0.145$). Finally, the entire bottom region is brought to a temperature slightly below the λ point. By virtue of the very high conductivity of superfluid helium, the cooling process can then propagate upwards. In an extreme case, a stationary regime is established when the heat introduced through the normal liquid and increased by additions of heat from different sources is in equilibrium with the cold produced by evaporation of the helium introduced in the chamber 18.

The surface of the helium bath is at a pressure determined by the means 14 and can especially be at atmospheric pressure, thus simplifying problems of leak-tightness. The known method and device just described accordingly make it possible to cool a helium-4 bath locally to a temperature in the vicinity of 2.17° K while maintaining a surface under atmospheric pressure and at the normal boiling temperature of 4.2 K, the normal helium-4 which has low heat conductivity being intended to constitute an insulating layer for the superfluid portion.

As stated earlier, this method and this device are limited to the production of superfluid helium having a temperature in the immediate vicinity of the λ transition temperature. The method and device according to the invention are precisely intended to reduce this temperature to a level well below this point. The means employed are those illustrated in FIG. 2.

In this figure, there is shown a cryostat 30 containing a helium bath 32, means 34 for supplying the cryostat with liquid helium, means 36 for maintaining the surface of the helium bath 32 at a suitable pressure (which can be atmospheric pressure). The apparatus comprises two chambers, one chamber 38 being placed at the upper portion and the other chamber 40 being placed at the lower portion of the apparatus, these two chambers being intended to communicate by means of a passageway 42; a cooling chamber 44 is immersed in the helium bath of the lower chamber 40 and communicates with heat-removal means 50.

During operation, normal helium HeI is present in the upper portion 46 and superfluid helium HeII is present within the lower portion 48 at a temperature $T_\lambda$ which differs only slightly from that of the λ point. Superfluid helium is present within the lower chamber 40 at a temperature $T_S < T_\lambda$ .

The passageway 42 contains a stream of superfluid helium which is subjected to a temperature difference $T_\lambda - T_S$ and the dimensions of said stream are such as to enable this latter to conduct a heat flux which is known as a critical flux for reasons which will become apparent later on in the description. Conversely, the existence of this critical thermal flux produces a temperature gradient between $T_\lambda$ and $T_S$.

An equilibrium is attained when the cold source 44 removes a power equal to P + Q if P designates the losses or evolutions of heat within the lower chamber 40 (these losses being represented schematically by the arrow P) and if Q designates the heat flux conducted through the passageway 42 from the upper chamber 38.

Figure 2:
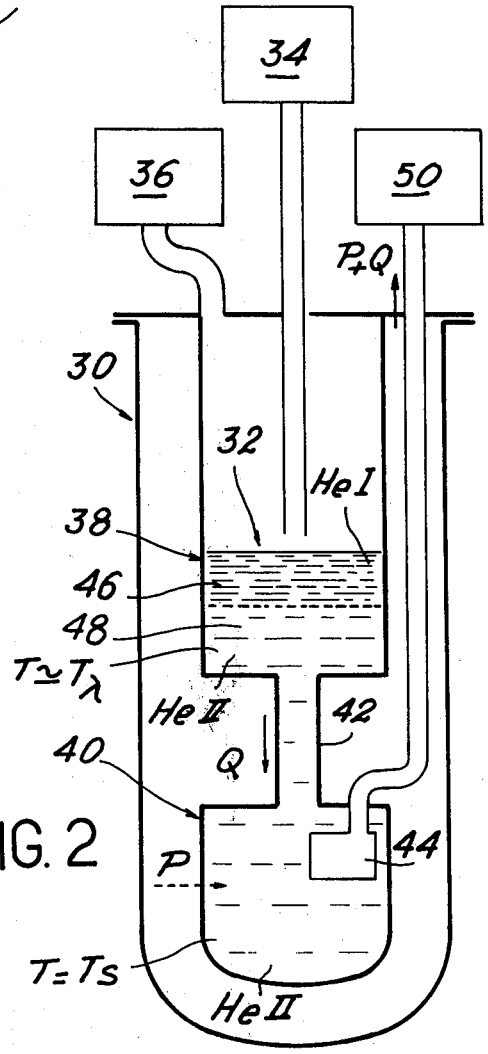
FIG. 2 is a diagram which illustrates the apparatus according to the invention.

IN order to explain the principle of operation of the apparatus which is illustrated in FIG. 2, we can briefly recall the exact meaning of a critical heat flux having a temperature gradient in a superfluid stream. Reference can be made in this connection to the article entitled "Critical fluxes within vertical open channels filled with superfluid helium under pressure," published by G. Claudet and L. Senet in "Comptes rendus a l'Academie des Sciences," Paris, Dec. 6th, 1972, volume 275, series B-67, page 845. The results published in this article show evidence of a particular property of heat-transfer processes in superfluid helium (between the vapor pressure and 3.5 atmospheres and in the case of temperatures ranging from 1.7° to 2.17° K). Heat-transfer processes in a bath of this type take place in two distinct regimes according to the value of the heat flux imposed. At low values of power and up to a value corresponding to a first critical flux, heat transfer takes place within superfluid helium with temperature gradients which can be considered as practically negligible (of the order of $10^{-5°}$ to $10^{-6°}$ K/cm). When the heat flux to be removed exceeds the value of said first critical flux, a steeper temperature gradient is liable to appear within the helium with which the flux conduction tube is filled. There is then obtained a new stable regime characterized by a second critical value of heat flux which corresponds to heating of one tube extremity to $T_\lambda$ and which depends mainly on the temperature of the bath and on the ease with which the convection movements can be established within the conduction passageway.

In other words, the superfluid helium under pressure gives rise to two critical heat fluxes which appear at different power levels. The first critical heat flux corresponds to low power levels and takes place practically without any temperature gradient. The second critical heat flux corresponds to higher power levels and takes place with a temperature gradient; this second flux is employed in the present invention.

By way of explanation, there is shown in FIG. 3 a curve which illustrates the variations in critical heat flux density Q corresponding to a thermal gradient within helium under pressure (38 torr to 2300 torr) as a function of the temperature T. The critical flux is expressed in W/cm² and the temperature is expressed in degrees absolute. This curve is obtained in the particular case of a passageway having a diameter of 1.3 mm and a length of 100 mm, one extremity of said passageway being at T whilst the other extremity is at $T_\lambda$.

These preliminary explanations will now be followed by a description relating to the operation of the device shown in FIG. 2. In the upper chamber 38, the operating conditions are substantially the same as in an apparatus of the type illustrated in FIG. 1: the temperature $T_\lambda$ of the superfluid HeII of the zone 48 is close to that of the λ point and a layer 46 of normal helium HeI remains at the surface. Within the passageway 42, a heat flux Q is established and the lower chamber 40 is cooled to a temperature $T_S$ such that the corresponding heat flux Q is equal to the critical flux which is accompanied by a thermal gradient and which has been defined in the foregoing. By way of example, in the case of a tube having a diameter of 1.3 mm and a length of 100 mm and in the case of a transmitted power level Q = 47.5 mW, the imposed flux amounts to 3.6 W/cm² and FIG. 3 indicates that a temperature $T_S$ of the superfluid bath of the chamber is lower than 1.9° K. In order to remove the necessary power, provision need only be made for a mechanical pump of 8 to 10 m³/hr corresponding to the means 50 of FIG. 2.

It has thus been possible to obtain baths of superfluid helium under pressure and to verify to within 0.001° K that these latter were stable, homogeneous and totally insensitive to periodic injections of normal helium at the surface of the bath.

It is clear from the foregoing explanations that the heat flux determines the temperature gradient $T_\lambda - T_S$ between the upper and lower chambers of the apparatus and therefore the temperature of equilibrium attained by the superfluid helium of the lower chamber. This heat flux is defined by two independent terms which are the power of the cold source 44 and the dimensions of the superfluid stream contained in the passageway 42. Adjustment of these two terms permits adjustment of the temperature obtained in the case of the superfluid. The cold source 44 and the passageway 42 will now be described in greater detail.

The cooling means 44 which are immersed in the superfluid helium of the lower chamber 40 can be constituted by any known means for removing heat at a temperature level below 2.17° K. Two examples of such means are illustrated in FIGS. 4 and 5 without thereby implying any limitation.

In FIG. 4, the cooling means are identical with those described in connection with FIG. 1 and consist of a chamber 60 which is immersed in the superfluid 62 to be cooled, said chamber being supplied with helium through a valve or a calibrated leak 64 which is also immersed in the helium bath 62; a pipe 65 connects the chamber 60 to pumping means 66 for pumping the vapors of the liquid 68 which is contained in the chamber 60 and evaporates while extracting heat from the bath 62.

It would clearly not constitute any departure from the scope of the invention to replace the valve 64 by a pipe connected to a liquid helium supply which is independent of the bath 62.

The means of FIG. 4 are suitable for installations which operate down to about 1.1° K. Below this temperature and down to about 0.7° K, the cooling means can advantageously be constituted by a helium refrigerator 3 as illustrated in FIG. 5. This refrigerator comprises a chamber 70 and liquid helium-3 is supplied to this latter through the pipe 74 by means 72; as the bath 76 of helium-3 evaporates, the vapors are pumped through the pipe 78 by means 80.

The pipes 74 and 78 can advantageously comprise a precooling device 82 which permits heat exchanges between the pipes and with the helium bath 84 contained in the upper chamber of the apparatus.

In order to reduce the temperature to about 0.1° K, it is possible to employ as cooling means an autonomous $He^3/He^4$ dilution refrigerator of known type or to employ the main bath for the purpose of precooling.

All these means make it possible to vary the temperature of the bath by adjusting the useful power extracted from the superfluid bath by producing action either directly on the operation of the refrigerator (for example by varying the flow rate) or indirectly on an ancillary heating system.

Figure 6:
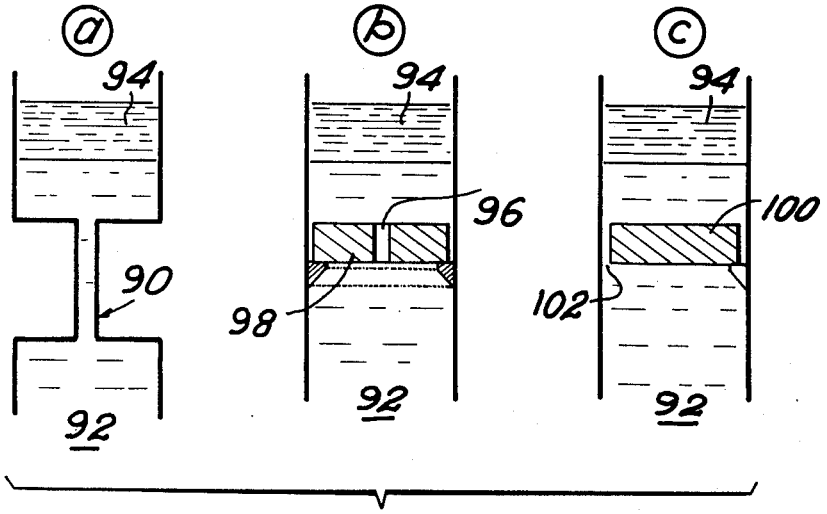
FIG. 6 illustrates a few examples of passageways which are designed to conduct a critical flux having a thermal gradient.

The second means on which action can be produced in order to adjust the temperature of the bath is (as stated earlier) the dimension of the superfluid stream which conducts the critical thermal flux. Without thereby implying any limitation, FIG. 6 illustrates three examples of passageways which can be employed in the apparatus according to the invention. In FIG. 6*a*, the passageway is constituted by a tube 90 which connects the lower chamber 92 to the other chamber 94. In FIG. 6*b*, these two chambers are connected to each other by the orifice 96 of a perforated partition-wall 98 formed of insulating material. In FIG. 6*c*, the chambers are connected to each other by means of a passageway constituted by the space formed between a disc 100 and the casing 102.

Figure 7:
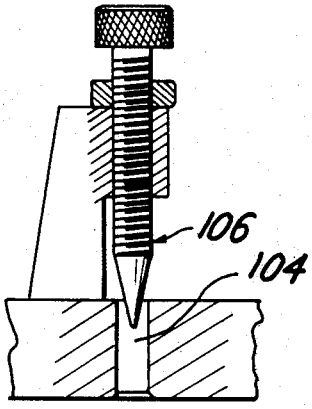
FIG. 7 illustrates a means for obtaining a variable-section passageway.

The value of the critical flux conducted through the superfluid passageway depends mainly on the cross-sectional area of said passageway and to a relatively slight extent on its length. It is therefore an advantage ot provide a variable-section passageway as is the case, for example, with the passageway shown in FIG. 7. As illustrated in this figure, the passageway 104 has a cross-sectional area which can be varied by introducing a conepoint screw 106 which shuts it off to a partial extent.

The apparatus according to the invention as illustrated in FIG. 2 comprises only one lower chamber 40 filled with superfluid helium but it would not constitute any departure from the invention to make provision for a plurality of chambers of this type, said chambers being connected to each other by means of passageways for conducting critical fluxes having thermal gradients as is shown by way of explanation in FIG. 8.

In FIG. 8, the upper chamber 100 is connected to a first lower chamber 101 which is in turn connected to a second lower chamber 102. Said lower chambers 101 and 102 are provided respectively with means 101' and 102' for removing power outputs $R_1$ and $R_2$.

The power output $R_1$ is equal to $P_1 + Q_1 - Q_2$ and the power output $R_2$ is equal to $P_2 + Q_2$ where $P_1$ and $P_2$ represent the losses or the evolutions of heat respectively within the chambers 101 and 102, where $Q_1$ represents the critical flux within the passageway 101'' which connects the chamber 101 to the chamber 100, where $Q_2$ represents the critical flux within the passageway 102'' which connects the chamber 102 to the chamber 100.

The passageway 102'' is not necessarily identical with the passageway 101''. The operation of an apparatus of this type is the same as that of FIG. 2, the thermal gradients being added and the temperature $T_2$ of the chamber 102 being lower than the temperature $T_1$ of the chamber 101.

There would naturally be no departure from the scope of the invention if the cooling means were placed only within the chamber 102. Similarly, there would not be any departure from the scope of the invention if more than two lower chambers were employed with a corresponding number of passageways for connecting these latter.

If the two lower chambers of FIG. 8 are connected in series, it nevertheless remains possible in another alternative form of construction to connect said chambers in parallel as is the case in the apparatus which is illustrated in FIG. 9. In this figure, the upper chamber 110 is connected to two lower chambers 111 and 112 respectively, said chambers being provided with cooling means 111' and 112' and connected to the upper chamber 110 by means of two passageways 111'' and 112'' respectively for conducting the critical fluxes corresponding to the establishment of temperature gradients.

It would naturally not constitute a departure from the scope of the invention to group superfluid-bath chambers together in series-parallel combinations, namely in arrangements which would result from combinations of FIGS. 8 and 9.

What we claim is:

1. A method for the production of superfluid helium under pressure at very low temperature, of the type in which a lower portion of a bath of helium-4 is cooled locally in order to cause its temperature to fall below the λ point, the lower portion of said bath being then converted into a superfluid-helium zone, wherein said method consists in connecting an upper portion of the superfluid zone to a lower portion of the superfluid zone by means of narrow stream of superfluid helium and in imposing within said stream a critical heat flux corresponding to the establishment of a temperature gradient by carrying out said cooling within said lower portion.

2. A method according to claim 1, wherein the temperature difference between said lower and upper portions of the superfluid zone is adjusted by modifying the value of said imposed critical heat flux.

3. A method according to claim 2, wherein the cooling applied to said lower portion of the superfluid zone is modified in order to change the value of said flux.

4. A method according to claim 2, wherein the dimensions and consequently the thermal conduction of said stream are modified in order to change the value of said flux.

5. An apparatus for the production of superfluid helium under pressure at very low temperature, said apparatus being of the type comprising a cryostat containing a liquid-helium bath, means for maintaining the helium pressure at the desired value, local cooling means immersed in said helium bath for causing the temperature of said bath to fall below the λ point, wherein said cryostat comprises:

an upper chamber in which superfluid helium collects at the lower portion of said chamber whilst normal helium remains in the upper portion of said chamber;

and at least one lower superfluid-helium chamber which is placed beneath said upper chamber and communicates therewith through at least one passageway having suitable dimensions for permitting the conduction of a critical heat flux having a thermal gradient, said cooling means being placed in at least one of said lower chambers containing the superfluid helium.

6. An apparatus according to claim 5, wherein said cooling means immersed in superfluid helium is constituted by means for the evaporation of liquid helium, said helium being derived from said bath.

7. An apparatus according to claim 5, wherein said cooling means immersed in superfluid helium are constituted by an autonomous refrigeration circuit with evaporation of helium-3 equipped if necessary with a precooling heat-exchanger immersed in the helium-4 bath.

8. An apparatus according to claim 5, wherein said cooling means immersed in the superfluid helium are constituted by an autonomous helium-3/helium-4 dilution refrigerator equipped if necessary with a precooling heat-exchanger immersed in said helium-4 bath.

9. An apparatus according to claim 5, wherein said passageway is constituted by a cylindrical tube of small diameter and especially of the order of one millimeter.

10. An apparatus according to claim 9, wherein the passageway is partially obstructed by a positionally-adjustable cone-point screw.

11. An apparatus according to claim 5, wherein said passageway is constituted by the orifice of a perforated partition-wall.

12. An apparatus according to claim 11, wherein the passageway is partially obstructed by a positionally-adjustable cone-point screw.

13. An apparatus according to claim 5, wherein said passageway is obtained by means of a disc mounted with clearance within a casing, said passageway being formed by the space provided between the casing and the periphery of said disc.

* * * * *